United States Patent [19]

Hayashi

[11] Patent Number: 4,656,974

[45] Date of Patent: Apr. 14, 1987

[54] V-TYPE ENGINE BOILING AND COOLING APPARATUS

[75] Inventor: Yoshimasa Hayashi, Kamakura, Japan

[73] Assignee: Nissan Motor Company, Limited, Yokohama, Japan

[21] Appl. No.: 758,221

[22] PCT Filed: Nov. 16, 1984

[86] PCT No.: PCT/JP84/00552

§ 371 Date: Jul. 16, 1985

§ 102(e) Date: Jul. 16, 1985

[30] Foreign Application Priority Data

Nov. 17, 1983 [JP] Japan ..... 58-216860

[51] Int. Cl.[4] ..... F01P 3/22

[52] U.S. Cl. ..... 123/41.21; 123/41.27

[58] Field of Search ..... 123/41.12, 41.2–41.27, 123/41.44

[56] References Cited

U.S. PATENT DOCUMENTS 1,787,562 1/1931 Barlow ..... 123/41.44

3,448,729 6/1969 Parsons ..... 123/41.2

4,553,505 11/1985 Hirano et al. ..... 123/41.79

*Primary Examiner*—William A. Cuchlinski, Jr.

*Attorney, Agent, or Firm*—Schwartz, Jeffery, Schwaab, Mack, Blumenthal & Evans

[57] ABSTRACT

A boiling and cooling apparatus for use in a V-type internal combustion engine. A connection passage (34) is connected between the water jackets (30, 31) formed in the respective banks of the V-type engine. The connection passage is formed with a collection port for collecting the vapor produced in the water jackets. The collected vapor is introduced into a condenser (7) in which it is cooled and liquerized. A level sensor (10) is provided in the connection passage for sensing the level of the coolant contained in the water jackets. When the sensed coolant level decreases below a predetermined value, coolant is introduced from a reservoir to the water jackets to maintain the coolant level at the predetermined value.

10 Claims, 1 Drawing Figure

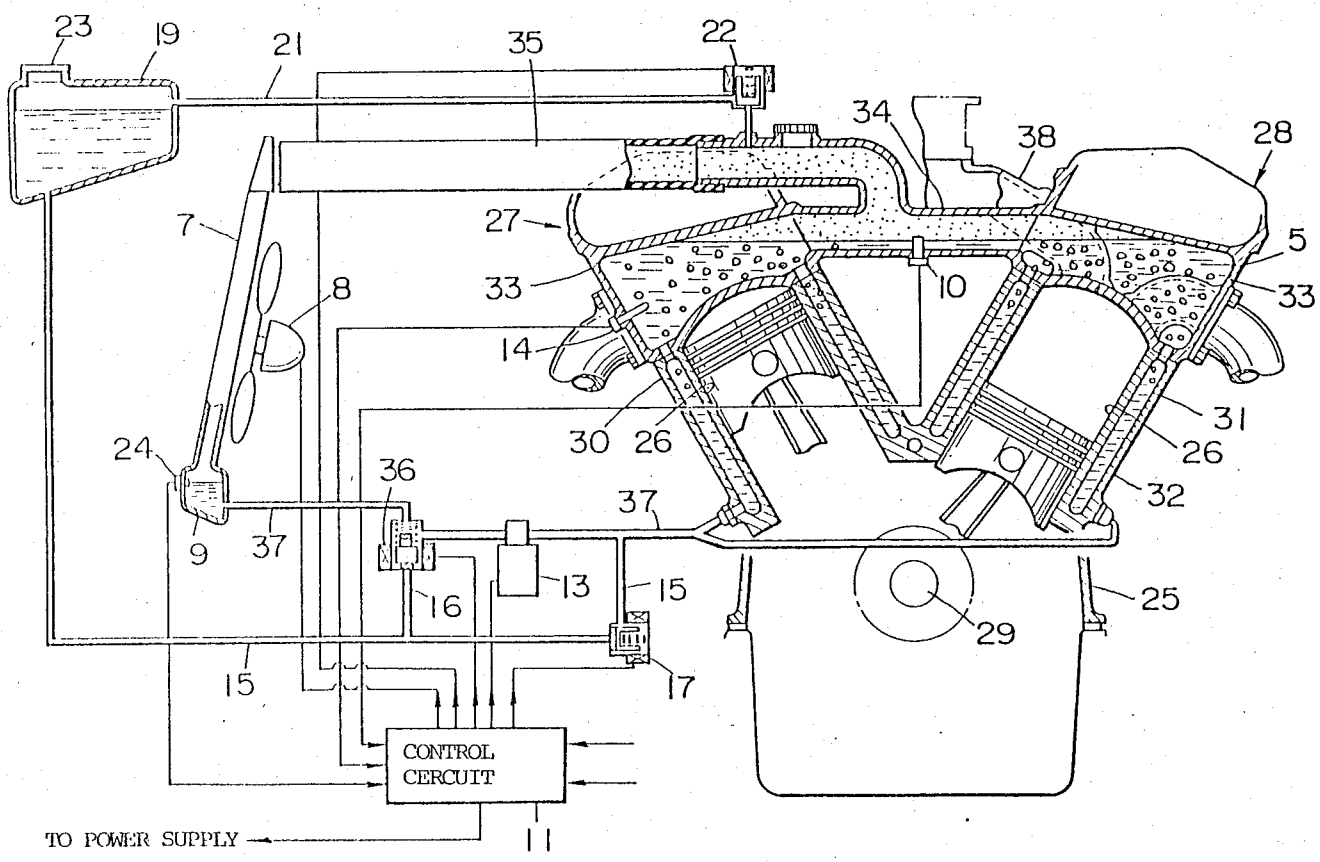
CONTROL CIRCUIT
TO POWER SUPPLY

V-TYPE ENGINE BOILING AND COOLING APPARATUS

FIELD OF THE INVENTION

This invention relates to a boiling and cooling apparatus which utilizes vaporized-coolant latent heat to cool an internal combustion engine. More particularly, the invention relates to a boiling and cooling apparatus for use in cooling a V-type engine with the cylinders arranged in a V configuration.

BACKGROUND OF THE INVENTION

In Europe Patent Laid Open No. 0 059 423 published on Sept. 8, 1982, there is disclosed an internal combustion engine cooling apparatus which generates steam within a water jacket, pressurizes the steam, cools the steam to liquefy the steam, decompresses the liquefied coolant to a normal pressure, and recirculates it to the water jacket.

In U.S. Pat. No. 3,448,729 granted to Persons on June 10, 1969, there is disclosed a boiling and cooling apparatus used to cool a V-type engine.

It is desirable for such a boiling and cooling apparatus to have a device which can furnish an adequate supply of coolant to the water jacket from a reservoir or low tank so as to maintain the coolant at a predetermined level within the water jacket. It has been proposed, in U.S. patent application Ser. No. 663,911, filed on Oct. 23, 1984, now U.S. Pat. No. 4,549,505, to provide a control device which controls a feed pump provided in a coolant supply passage connected between the reservoir and the water jacket. A level sensor, connected to the control device, is provided to monitor the level of the coolant contained in the water jacket. The control device drives the feed pump to maintain the coolant level above the predetermined value when the level sensor detects the coolant level falling below the predetermined value.

If such a boiling and cooling apparatus is applied to a V-type engine which normally has separate cylinder-head water jackets formed in the cylinder blocks of the respective banks, it is required to compensate for coolant level variations produced when the vehicle is rolling or running on a slope by providing a plurality of level sensors at different positions in the engine. This in turns increases the cost, sophisticates the coolant level control, and results in a slow coolant level control response.

In addition, bubbles form to unsettle the coolant surface in the cylinder-head water jackets of the respective banks so as to introduce errors in the coolant level measurement when the coolant is boiled.

SUMMARY OF THE INVENTION

It is therefore a main object of the present invention to provide a boiling and cooling apparatus suitable for use with V-type engines.

It is another object of the present invention to permit the use of a single level sensor for sensing the levels of the coolant contained in the banks of a V-type engine.

It is still another object of the present invention to provide a boiling and cooling apparatus which can increase the level measurement accuracy by providing a level sensor at a position where the coolant level is relatively stable in the water jackets.

The above and other objects can be achieved, in accordance with the present invention, by providing a boiling and cooling apparatus for use with a V-type engine, the apparatus comprising a connection passage connected between the water jackets provided in the respective banks of the V-type engine. The connection passage is open into the vapor inlet of a vapor passage. The vapor generated in the water jackets is introduced from the vapor inlet opening into the connection passage through the vapor passage to a condenser. A level sensor is provided in the connection passage for sensing the level of the coolant contained in the connection passage which corresponds to the levels of the coolant contained in the water jackets of the respective banks. The level sensor generates a sensor signal when the level of the coolant contained in the connection passage drops below a predetermined value. This sensor signal is applied to a control circuit which thereby generates a control signal to drive a feed pump so as to supply coolant from a reservoir or a low tank to the water jackets.

With the apparatus arranged as stated above, the vapor generated in the water jackets of the respective banks can be introduced through the vapor passage to the condenser, resulting in a simple and light boiling and cooling apparatus.

According to the present invention, the level sensor is provided in the connection passage connected between the water jackets so that it can measure the level of the coolant contained in the connection passage which represents the average of the levels of coolant contained in the water jackets. This eliminates the need for a level sensor for each of the water jackets of the respective banks. This in turns reduces the cost and simplifies the control calculations made in the control circuit. In addition, since the level sensor is provided to sense the level of coolant contained in the connection passage which is more stable than the level of the coolant contained in the water jackets, the sensor can measure the coolant level with greater accuracy.

BRIEF DESCRIPTION OF THE DRAWINGS

The single FIGURE is a diagram showing one preferred embodiment of a boiling and cooling apparatus for use with V-type engines made in accordance with the present invention.

PREFERRED EMBODIMENT OF THE INVENTION

The single FIGURE shows one embodiment of a V-type engine boiling and cooling apparatus made in accordance with the present invention. As well known in the art, a V-type engine 25, such as V-6, V-8, or the like, has cylinders divided into two groups 27 and 28, the cylinder groups 27 and 28 being arranged at a bank angle with respect to the crankshaft 29.

Water jackets 30 and 31 are formed around the V-type engine cylinders 26 between the cylinder block 32 and the cylinder head 33.

A connection passage 34 is formed to connect the water jackets 30 and 31 at a position near the cylinder head 33.

The connection passage 34 is a linear passage extending substantially in the horizontal direction. In greater detail, the connection passage extends through the side surfaces of the cylinder heads 33 and connects the uppermost portions of the water jackets 30 and 31.

The water jackets 30 and 31 are charged with coolant 5 which is maintained at a desired level during normal operation, as described later. The coolant 5 fills the water jackets 30 and 31 and the connection passage 34 except for their upper portions and it is introduced from the jackets 30 and 31 to the connection passage 34 so that the coolant contained in the jackets 30 and 31 and the connection passage 34 is at the same level.

A level sensor 10 is mounted centrally in the connection passage 34 to detect the desired level of the coolant contained in the water jackets 30 and 31.

The level sensor 10 produces a sensor signal which is applied to a control circuit 11 along with a signal produced from a level sensor positioned in the low tank 9 and a signal produced from a temperature sensor 14 positioned in the coolant 5 contained in the water jacket 30.

A vapor passage 35 is open into the upper portion of the connection passage 34. The vapor passage 35 is connected to a condenser 7.

The condenser 7 is provided with a cooling fan (electric fan) 8 which creates cooled air flow to radiate heat from the vaporized coolant so as to cool the coolant to an extent corresponding to the rate of the cooled air flow. As a result, the coolant is condensed into liquid form. The liquefied coolant is stored in the low tank 9.

The level of the coolant decreases to some extent when the coolant 5 is vaporized. The level sensor 10, provided intermediate the connection passage 34 connected between the water jackets 30 and 31, detects the coolant level decrease, causing the control circuit 11 to drive a feed pump 13 which is provided in a return passage (coolant passage) 37 leading from the water jackets 2. The feed pump 13 recirculates the coolant 5 through a closed circuit from the low tank 9 to the water jackets 30 and 31.

The control circuit 11 operates to set the engine coolant temperature at an optimum value in accordance with operating conditions by controlling the cooling fan 8 based upon the coolant temperature sensed by the coolant temperature sensor 14, engine rotation, accelerator pedal position, the amount of fuel to the engine, and other engine operating conditions. Since the cooling system forms a closed circuit, the control circuit can vary the boiling point of the coolant by varying the pressure in the system.

For example, the control circuit increases the boiling point of the coolant by decreasing the rate of cooled air flow which in turn suppresses the degree of radiation and condensation made in the condenser 7 to some extent increasing the pressure in the cooling system over the atmospheric pressure at low load conditions where the engine produces a relatively small degree of heat. Since the engine coolant temperature remains at a high level (for example, 120° C.) under this condition, it is possible to minimize the cooling loss.

In high load conditions where the engine produces a relative great degree of heat, the control circuit decreases the boiling point of the coolant by increasing the rate of cooled air flow which in turn promotes the degree of radiation and condensation made in the condenser 7 so as to decrease the pressure in the cooling system below the atmospheric pressure. Since the engine coolant temperature remains at a low level (for example, 90° C.) under this condition, it is possible to ensure good cooling performance.

Due to the fact that the boiled or cooled coolant 5 has an extremely great latent heat and a sufficient degree of heat is radiated from the vapored coolant in the condenser 7, a little amount of coolant 5 is required to cool the engine in an efficient manner. In addition, the cooling temperature is controlled in fast response to variations in engine operating conditions. It is, therefore, apparent that the control cirucit can provide superior cooling performance.

The control circuit 11 is also connected to the coolant passage 37 and the feed pump 13. The control circuit opens the coolant passage 37 based upon the coolant level sensed by the level sensor 10 and drives the feed pump 13 based upon the coolant level sensed by the level sensor 10 so as to maintain the coolant 5 at a desired level in the water jackets 30 and 31 and recirculate the coolant 5 liquefied in the condenser 7 from the low tank 9 to the water jackets 30 and 31.

With such an apparatus, however, the vaporized coolant would be liquefied to decrease the pressure to a considerable extent producing a negative pressure in the system when the coolant temperature decreases to a normal level after the engine comes to a stop.

In order to avoid this difficulty, an auxiliary tank 19 is provided which is connected to the water jackets 30 and 31 through auxiliary passages 15 and 16 having solenoid valves 17 and 36, respectively. When the engine comes to a stop, a pressure difference between the decreased system pressure and the atmospheric pressure to open the auxiliary passage 15 so as to introduce the coolant from the auxiliary tank 19 in a manner to increase the coolant to the level sensed by the level sensor 20.

In order to remove air which would enter the water jackets 30 and 31 due to a reduction of the pressure in the system, a solenoid valve 22 is provided which is placed in an air passage 21 connected to the upper portion of the vapor passage 6. For example, in the initial stage of engine starting operation, the control circuit opens the air and auxiliary passages 21 and 16 and drives the feed pump 13 to force the coolant to flow from the auxiliary tank 19 so as to remove extra air and adjust the coolant level to the desired level. The removed air is introduced to the upper air layer of the auxiliary tank 19 and is exhausted through a filter 23 to the exterior.

It is, therefore, possible to prevent flow of air into the system and enable heat exchange with high efficiency in the condenser 7.

This results in optimum cooling performance. In addition, the coolant pressure at the boiling point thereof can be controlled below the atmospheric pressure in accordance with the rate of air flow produced by the cooling fan 8. Thus, it is possible to set the cooling temperature below 100° C. at high load conditions.

Since the above apparatus can cool the engine with a little amount of coolant, the sizes of the water jackets 2, the condenser 7, and the feed pump 13 can be diminished, resulting in a compact and light cooling system. In addition, since the efficiency of heat radiation of the condenser 7 is high, the power required to drive the cooling fan 8 can be reduced to improve noise reduction and fuel economy.

The control operation of the control circuit 11 is described in U.S. patent application Ser. No. 663,911, filed on Oct. 28, 1984, now U.S. Pat. No. 4,549,505. The disclosure of U.S. patent application Ser. No. 663,911 is incorporated herein by reference.

With the apparatus arranged as described above, the vapor generated during normal operation in the water jackets 30 and 31 provided for the respective cylinder groups 27 and 28 is collected in the upper spaces of the jackets 30 and 31 and the connection passage 34 and is introduced to the condenser 7 through the vapor passage 35 connected to the connection passage 34.

This is the reason for that the arrangement is simple in spite of the fact that the water jackets 30 and 31 are provided separately. In addition, the generated steam can be taken out through the connection passage 34.

The water jackets 30 and 31 are connected to each other through the connection passage 34 so that the coolant contained in the water jackets is maintained at the same level.

This permits a single level sensor 10 provided in the connection passage 34 to sense the levels of the coolant contained in the jackets 30 and 31 with great accuracy.

Since the levels of the coolant contained in the separate water jackets 30 and 31 can be controlled to a desired level, no error can be introduced in coolant level measurement. This permits uniform cooling of the respective cylinders 26.

In such a manner, the present invention provides a simple boiling and cooling apparatus for use in a V-type engine which can perform accurate level control.

Since the level sensor 10 is positioned substantially intermediate the connection passage 34, the coolant level at the center of the connection passage cannot vary even when the engine is inclined during vehicle rolling or pitching or when the vehicle is accelerated to incline the levels of the coolant contained in the water jackets 30 and 31. This permits accurate level measurement.

Fuel atomization can be promoted by arranging the engine intake passage 38 around the connection passage 34 to heat the air flowing therethrough. This arrangement facilitates generation of vapor in early time, resulting in superior driveability in the cold.

I claim:

1. An internal combustion engine comprising:

a radiator;

means for forming a first combustion chamber;

means for forming a first coolant chamber around said first combustion chamber, said first coolant chamber being adapted to discharge vaporized coolant;

means for forming a second combustion chamber;

means for forming a second coolant chamber around said second combustion chamber, said second coolant chamber being adapted to receive liquefied coolant from said radiator and discharge vaporized coolant;

a mechanism provided between said first and second coolant chambers at a position above or higher than the positions of said first and second combustion chambers for collecting vaporized coolant, said mechanism communicating with said radiator for introducing vaporized coolant to said radiator to liquefy the same in same radiator;

a first level sensor sensitive to the level of the coolant contained in said collecting mechanism, said first level sensor deriving a control signal based on the sensed coolant level so as to control said coolant level in said collecting mechanism at a predetermined level; and a coolant circulating circuit means connecting said first and second coolant chamber, said radiator and said collecting mechanism and including a valve means responsive to said control signal to control the amount of the coolant to be introduced from said radiator to said first and second coolant chambers so as to maintain the coolant level at said predetermined value in said collecting chamber.

2. The engine as claimed in claim 1, wherein said means for forming first and second combustion chambers includes first and second cylinders, said first and second cylinders being arranged at an angle with respect to a crankshaft.

3. The engine as claimed in claim 2, wherein said engine is a V-type engine.

4. An internal combustion engine comprising:

a radiator;

a reservoir containing a coolant;

means for forming a first combustion chamber;

means for forming a first coolant chamber around said first combustion chamber, said first coolant chamber being adapted to discharge vaporized coolant;

means for forming a second combustion chamber;

means for forming a second coolant chamber around said second combustion chamber, said second coolant chamber being adapted to receive liquefied coolant from said radiator and discharge vaporized coolant;

a mechanism provided between said first and second coolant chambers for collecting vaporized coolant, said mechanism communicating with said radiator for introducing vaporized coolant to said radiator to liquefy the same in said radiator;

a first level sensor sensitive to the level of the coolant contained in said collecting mechanism, said first level sensor generating an output to control the amount of the coolant to be introduced from said radiator to said first and second coolant chambers so as to maintain the coolant level at a predetermined value in said collecting mechanism;

a pump for recirculating liquefied coolant from said radiator to the first and second coolant chambers;

a first passage for introducing coolant from said radiator to said first and second coolant chambers and having a first valve movable between open and closed positions, said first valve permitting coolant flow from said radiator to said first and second coolant chambers at the open position, said first valve preventing coolant flow from said radiator to said first and second coolant chambers at the closed position;

a second passage connected at its one end to said reservoir and to said first and second coolant chambers at the other end and having a second valve movable between open and closed positions for establishing and blocking communication between said reservoir and said first and second chambers;

a third passage connected at its one end to said reservoir and at the other end thereof to said first passage at a position between said radiator and said pump, said third passage having a third valve movable between open and closed positions for establishing and blocking communication between said radiator and said first passage; and a control circuit for controlling the operations of said first, second and third valves based on the coolant level in said collection mechanism sensed by said first level sensor in order to maintain the coolant level in said collecting mechanism at a predetermined level.

5. The engine as claimed in claim 4, which includes a fourth passage connected between the uppermost portion of said collecting mechanism and said reservoir, said fourth passage having a fourth valve for controlling coolant flow between said collecting mechanism uppermost portion and said reservoir.

6. The engine as claimed in claim 5, wherein said control circuit is responsive to an output from said first level sensor for driving said pump to maintain the liquefied coolant contained in said coolant chambers at a first predetermined level.

7. The engine as claimed in claim 6, which includes a temperature sensor sensitive to the temperature of the coolant contained in said first and second coolant chambers, and a device for controlling the percentage of the liquefied coolant of the gaseous coolant contained in said radiator, and wherein said control circuit is responsive to an output from said temperature sensor for driving said device to increase the percentage of the liquefied coolant in said radiator when the coolant temperature exceeds a predetermined value in said coolant chambers.

8. The engine as claimed in claim 7, which includes a compact tank provided on the bottom of said radiator for collecting liquefied coolant, and a second level sensor sensitive to a second predetermined level of the liquefied coolant contained in said tank.

9. The engine as claimed in claim 8, which includes a third level sensor provided on the uppermost position of said collecting mechanism for sensing the liquefied coolant reaching said uppermost position when the engine stands still.

10. The engine as claimed in claim 9, wherein said control cirucit includes a microprocessor responsive to data inputted thereto from said first, second and third level sensors and said temperature sensor for operating said device and said first, second, third and fourth valves.

* * * * *